US007413018B2

(12) United States Patent
Hosie et al.

(10) Patent No.: US 7,413,018 B2
(45) Date of Patent: Aug. 19, 2008

(54) APPARATUS FOR WELLBORE COMMUNICATION

(75) Inventors: David G. Hosie, Sugar Land, TX (US); Michael J. Lynch, Houston, TX (US); Jack Allen, Porter, TX (US); David Pavel, Kingwood, TX (US); Joe Noske, Houston, TX (US); Allen R. Young, Houston, TX (US); Kenneth M. Nero, Houston, TX (US); Ram Kumar Bansal, Houston, TX (US); Tuong Thanh Le, Katy, TX (US); Kenneth Edmund Rozek, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 258 days.

(21) Appl. No.: 10/888,554

(22) Filed: Jul. 9, 2004

(65) Prior Publication Data

US 2005/0056419 A1 Mar. 17, 2005
US 2007/0256829 A9 Nov. 8, 2007

Related U.S. Application Data

(63) Continuation-in-part of application No. 10/288,229, filed on Nov. 5, 2002, now Pat. No. 7,350,590.

(60) Provisional application No. 60/485,816, filed on Jul. 9, 2003.

(51) Int. Cl.
*E21B 47/00* (2006.01)

(52) U.S. Cl. ..... 166/379; 166/65.1; 175/40

(58) Field of Classification Search ..... 166/379, 166/65.1, 66; 175/40
See application file for complete search history.

(56) References Cited

U.S. PATENT DOCUMENTS

| | | | |
|---|---|---|---|
| 2,290,408 | A | 7/1942 | Crites |
| 3,362,487 | A | 1/1968 | Lindsey |
| 3,517,553 | A | 6/1970 | Williams |
| 3,552,502 | A | 1/1971 | Wilson |
| 3,986,350 | A | 10/1976 | Schmidt |
| 4,087,781 | A | 5/1978 | Grossi et al. |
| 4,247,312 | A | 1/1981 | Thakur |

(Continued)

FOREIGN PATENT DOCUMENTS

GB 2 058 881 4/1981

(Continued)

OTHER PUBLICATIONS

U.K. Search Report, Application No. GB0415449.8, dated Nov. 25, 2004.

(Continued)

*Primary Examiner*—William P Neuder
(74) *Attorney, Agent, or Firm*—Patterson & Sheridan, L.L.P.

(57) ABSTRACT

Methods and apparatus for communicating between surface equipment and downhole equipment. One embodiment of the invention provides a wellhead assembly that allows electrical power and signals to pass into and out of the well during drilling operations, without removing the valve structure above the wellhead. Another embodiment of the invention provides an electromagnetic casing antenna system for two-way communication with downhole tools. Another embodiment of the invention provides an antenna module for a resistivity sub that effectively controls and seals the primary/secondary interface gap.

64 Claims, 13 Drawing Sheets

U.S. PATENT DOCUMENTS

| | | | | | |
|---|---|---|---|---|---|
| 4,289,199 | A | | 9/1981 | McGee | |
| 4,297,880 | A | | 11/1981 | Berger | |
| 4,440,239 | A | | 4/1984 | Evans | |
| 4,458,903 | A | | 7/1984 | Tohill | |
| 4,623,020 | A | | 11/1986 | Nichols | |
| 4,630,675 | A | | 12/1986 | Neipling | |
| 4,775,009 | A | | 10/1988 | Wittrisch | |
| 4,785,247 | A | * | 11/1988 | Meador et al. | 324/338 |
| 5,010,966 | A | | 4/1991 | Stokley | |
| 5,303,773 | A | | 4/1994 | Czernichow | |
| 5,355,952 | A | | 10/1994 | Meynier | |
| 5,661,402 | A | * | 8/1997 | Chesnutt et al. | 324/338 |
| 5,857,522 | A | | 1/1999 | Bradfield | |
| 5,892,860 | A | | 4/1999 | Maron | |
| 5,900,137 | A | | 5/1999 | Homan | |
| 5,928,519 | A | | 7/1999 | Homan | |
| 5,971,072 | A | | 10/1999 | Huber | |
| 6,035,952 | A | | 3/2000 | Bradfield | |
| 6,072,567 | A | | 6/2000 | Sapack | |
| 6,138,774 | A | | 10/2000 | Bourgoyne, Jr. | |
| 6,209,663 | B1 | | 4/2001 | Hosie | |
| 6,234,258 | B1 | | 5/2001 | Karigan | |
| 6,328,118 | B1 | | 12/2001 | Karigan | |
| 6,343,649 | B1 | | 2/2002 | Beck | |
| 6,352,129 | B1 | | 3/2002 | Best | |
| 6,354,147 | B1 | | 3/2002 | Gysling | |
| 6,374,925 | B1 | | 4/2002 | Elkins | |
| 6,386,288 | B1 | | 5/2002 | Snider | |
| 6,422,084 | B1 | | 7/2002 | Fernald | |
| 6,425,444 | B1 | | 7/2002 | Metcalfe | |
| 6,427,776 | B1 | | 8/2002 | Hoffman | |
| 6,429,784 | B1 | | 8/2002 | Beique | |
| 6,457,540 | B2 | | 10/2002 | Gardes | |
| 6,484,816 | B1 | | 11/2002 | Koederitz | |
| 6,527,062 | B2 | | 3/2003 | Elkins | |
| 6,575,244 | B2 | | 6/2003 | Chang | |
| 6,607,042 | B2 | | 8/2003 | Hoyer | |
| 6,668,943 | B1 | | 12/2003 | Maus | |
| 6,693,554 | B2 | | 2/2004 | Beique | |
| 6,727,827 | B1 | | 4/2004 | Edwards | |
| 6,747,570 | B2 | | 6/2004 | Beique | |
| 6,755,261 | B2 | | 6/2004 | Koederitz | |
| 6,814,142 | B2 | | 11/2004 | Paulk | |
| 6,920,942 | B2 | | 7/2005 | Koederitz | |
| 6,987,463 | B2 | | 1/2006 | Beique | |
| 7,044,237 | B2 | | 5/2006 | Leuchtenberg | |
| 7,044,239 | B2 | | 5/2006 | Pinckard | |
| 7,046,165 | B2 | | 5/2006 | Beique | |
| 2003/0079874 | A1 | | 5/2003 | Otten et al. | |
| 2004/0079532 | A1 | | 4/2004 | Allen et al. | |
| 2004/0139791 | A1 | | 7/2004 | Johansen | |
| 2004/0178003 | A1 | | 9/2004 | van Riet | |
| 2004/0231889 | A1 | | 11/2004 | van Riet | |
| 2005/0092523 | A1 | | 5/2005 | McCaskill | |
| 2006/0011236 | A1 | | 1/2006 | Suter | |
| 2006/0037781 | A1 | | 2/2006 | Leuchtenberg | |
| 2006/0086538 | A1 | | 4/2006 | van Riet | |
| 2006/0113110 | A1 | | 6/2006 | Leuchtenberg | |
| 2006/0124300 | A1 | | 6/2006 | Steiner | |
| 2006/0207795 | A1 | | 9/2006 | Kinder | |

FOREIGN PATENT DOCUMENTS

| | | |
|---|---|---|
| GB | 2 330 598 | 4/1999 |
| GB | 2 335 453 | 9/1999 |
| WO | WO 86/03799 | 7/1986 |

OTHER PUBLICATIONS

CA Office Action, Application No. 2,473,511, dated Aug. 1, 2006.

GB SearchReport, Application No. GB0625226.6, dated Sep. 13, 2007.

Downhole Deployment Valve Bulletin, Weatherford International Ltd. (online), Jan. 2003, p. 1.

Nimir Field in Omar Proves the Downhole Deployment Valve a Vital Technological Key to Succes, Weatherford International Inc., 2003, p. 1.

* cited by examiner

APPARATUS FOR WELLBORE COMMUNICATION

CROSS-REFERENCE TO RELATED APPLICATIONS

This application claims benefit of U.S. provisional patent application Ser. No. 60/485,816, filed Jul. 9, 2003, which is herein incorporated by reference.

This application is a continuation-in-part of U.S. patent application Ser. No. 10/288,229, filed Nov. 5, 2002, now U.S. Pat. No. 7,350,590.

BACKGROUND OF THE INVENTION

1. Field of the Invention

The present invention generally relates to methods and apparatus for use in oil and gas wellbores. More particularly, the invention relates to methods and apparatus for communicating between surface equipment and downhole equipment.

2. Description of the Related Art

Oil and gas wells typically begin by drilling a borehole in the earth to some predetermined depth adjacent a hydrocarbon-bearing formation. Drilling is accomplished utilizing a drill bit which is mounted on the end of a drill support member, commonly known as a drill string. The drill string is often rotated by a top drive or a rotary table on a surface platform or rig. Alternatively, the drill bit may be rotated by a downhole motor mounted at a lower end of the drill string. After drilling to a predetermined depth, the drill string and drill bit are removed and a section of the casing is lowered into the wellbore. An annular area is formed between the string of casing and the formation, and a cementing operation is then conducted to fill the annular area with cement. The combination of cement and casing strengthens the wellbore and facilitates the isolation of certain areas of the formation behind the casing for the production of hydrocarbons.

It is common to employ more than one string of casing in a wellbore. Typically, the well is drilled to a first designated depth with a drill bit on a drill string. The drill string is then removed, and a first string of casing or conductor pipe is run into the wellbore and set in the drilled out portion of the wellbore. Cement is circulated into the annulus outside the casing string. The casing strengthens the borehole, and the cement helps to isolate areas of the wellbore during hydrocarbon production. The well may be drilled to a second designated depth, and a second string of casing or liner is run into the drilled out portion of the wellbore. The second string of casing is set at a depth such that the upper portion of the second string of casing overlaps the lower portion of the first string of casing. The second liner string is fixed or hung off the first string of casing utilizing slips to wedge against an interior surface of the first casing. The second string of casing is then cemented. The process may be repeated with additional casing strings until the well has been drilled to a target depth.

Historically, wells are drilled in an "overbalanced" condition wherein the wellbore is filled with fluid or mud in order to prevent the inflow of hydrocarbons until the well is completed. The overbalanced condition prevents blow outs and keeps the well controlled. While drilling with weighted fluid provides a safe way to operate, there are disadvantages, like the expense of the mud and the damage to formations if the column of mud becomes so heavy that the mud enters the formations adjacent the wellbore. In order to avoid these problems and to encourage the inflow of hydrocarbons into the wellbore, underbalanced or near underbalanced drilling has become popular in certain instances. Underbalanced drilling involves the formation of a wellbore in a state wherein any wellbore fluid provides a pressure lower than the natural pressure of formation fluids. In these instances, the fluid is typically a gas (e.g., nitrogen or a gasified liquid), and its purpose is to carry out cuttings or drilling chips produced by a rotating drill bit. Since underbalanced well conditions can cause a blow out, they must be drilled through some type of pressure device like a rotating drilling head at the surface of the well to permit a tubular drill string to be rotated and lowered therethrough while retaining a pressure seal around the drill string. Even in overbalanced wells there is a need to prevent blow outs. In most instances, wells are drilled through blow out preventers in case of a pressure surge.

A significant difference between conventional overbalanced drilling and underbalanced drilling is that in the latter fluid pressure in the well acts on the drill string. Consequently, when the drill string is inserted into the well or removed from the well, the drill string tends to be thrown out of the well due to fluid pressure acting on it from the bottom. As the formation and completion of an underbalanced or near underbalanced well continues, it is often necessary to insert a string of tools into the wellbore that cannot be inserted through a rotating drilling head or blow out preventer due to their shape and relatively large outer diameter. In these instances, a lubricator that consists of a tubular housing tall enough to hold the string of tools is installed in a vertical orientation at the top of a wellhead to provide a pressurizable temporary housing that avoids downhole pressures. The use of lubricators is well known in the art. By manipulating valves at the upper and lower end of the lubricator, the string of tools can be lowered into a live well while keeping the pressure within the well localized. Even a well in an overbalanced condition can benefit from the use of a lubricator when the string of tools will not fit though a blow out preventer.

While lubricators are effective in controlling pressure, some strings of tools are too long for use with a lubricator. For example, the vertical distance from a rig floor to the rig draw works is typically about ninety feet or is limited to that length of tubular string that is typically inserted into the well. If a string of tools is longer than ninety feet, there is not room between the rig floor and the draw works to accommodate a lubricator. In these instances, a down hole deployment valve or DDV can be used to create a pressurized housing for the string of tools. In general, downhole deployment valves are well known in the art, and one such valve is described in U.S. Pat. No. 6,209,663, which is incorporated by reference herein in its entirety. A downhole deployment valve (DDV) eliminates the need for any special equipment (e.g., a snubber unit or a lubricator), which is expensive and slows down the work progress, to facilitate tripping in or tripping out the drill string from the well during underbalanced drilling. Since the DDV is a downhole pressure containing device, it also enhances safety for personnel and equipment on the drilling job.

Generally, a DDV is run into a well as part of a string of casing. The DDV is initially in an open position with a flapper member in a position whereby the full bore of the casing is open to the flow of fluid and the passage of tubular strings and tools into and out of the wellbore. The valve taught in the '663 patent includes an axially moveable sleeve that interferes with and retains the flapper in the open position. Additionally, a series of slots and pins permits the valve to be openable or closable with pressure but to then remain in that position without pressure continuously applied thereto. A control line runs from the DDV to the surface of the well and is typically hydraulically controlled. With the application of fluid pressure through the control line, the DDV can be made to close so that its flapper seats in a circular seat formed in the bore of the casing and blocks the flow of fluid through the casing. In this manner, a portion of the casing above the DDV is isolated from a lower portion of the casing below the DDV.

The DDV is used to install a string of tools in a wellbore. When an operator wants to install the tool string, the DDV is closed via the control line by using hydraulic pressure to close the mechanical valve. Thereafter, with an upper portion of the wellbore isolated, a pressure in the upper portion is bled off to bring the pressure in the upper portion to a level approximately equal to one atmosphere. With the upper portion depressurized, the wellhead can be opened and the string of tools run into the upper portion from a surface of the well, typically on a string of tubulars. A rotating drilling head or other stripper like device is then sealed around the tubular string, and movement through a blowout preventer can be re-established. In order to reopen the DDV, the upper portion of the wellbore is repressurized to permit the downwardly opening flapper member to operate against the pressure therebelow. After the upper portion is pressurized to a predetermined level, the flapper can be opened and locked in place, and thus, the tool string is located in the pressurized wellbore.

In the production environment, cables (electrical, hydraulic and other types) are passed through the wellhead assembly at the surface, typically passing vertically through the top plate. Pressure seal is maintained utilizing sealing connector fittings such as NTP threads or O-ring seals. However, there does not exist a system that allows passage of the electrical power and signals through the wellhead assembly during drilling operations. A wellhead assembly that allows electrical power and signals to pass into and out of the well during drilling operations, without having to remove the valve structure above the wellhead, would provide time and cost savings. Furthermore, such wellhead assembly would provide the ability to demonstrate the performance of a tool (e.g., a DDV) through monitoring during drilling operations. Thus, there is a need for a wellhead assembly that allows electrical power and signals to pass into and out of the well during drilling operations.

Another problem encountered by many prior art downhole measurement systems is that these conventional systems lack reliable data communication to and from control units located on a surface. For example, conventional measurement while drilling (MWD) tools utilize mud pulse telemetry which works fine with incompressible drilling fluids such as a water-based or an oil-based mud; however, mud pulse telemetry does not work with gasified fluids or gases typically used in underbalanced drilling. An alternative to mud pulse telemetry is electromagnetic (EM) telemetry where communication between the MWD tool and the surface monitoring device is established via electromagnetic waves traveling through the formations surrounding the well. However, EM telemetry suffers from signal attenuation as it travels through layers of different types of formations in the earth's lithosphere. Any formation that produces more than minimal loss serves as an EM barrier. In particular, salt domes and water-bearing zones tend to completely moderate the signal. One technique employed to alleviate this problem involves running an electric wire inside the drill string from the MWD tool up to a predetermined depth from where the signal can come to the surface via EM waves. Another technique employed to alleviate this problem involves placing multiple receivers and transmitters in the drill string to provide boost to the signal at frequent intervals. However, both of these techniques have their own problems and complexities. Currently, there is no available means to cost efficiently relay signals from a point within the well to the surface through a traditional control line. Thus, there is a need for an electromagnetic communication system for two-way communication with downhole tools that addresses the limitations of EM telemetry such as the gradual decay of EM waves as the EM waves pass through the earth's lithosphere and when a salt dome or water-bearing zone is encountered.

Another communication problem associated with typical drilling systems involves the resistivity subs which contain the antennas for transmitting and receiving electromagnetic signals. Traditional resistivity subs integrated induction coils, electric circuits and antennas within the thick section of the drill collar. This method is costly to manufacture and can be difficult to service. One recently developed resistivity sub employs a separate induction coil antenna assembly fitted inside an antenna module. Each of these modules are centralized inside of the drill collar. The resistivity sub sends and receives well-bore signals via a number of antenna modules placed directly above the secondary induction coils. The sending antennas receive electrical signals from the primary induction coils and send the signals through the secondary induction coils to the wellbore. The receiving antennas do the opposite. The sending and receiving antenna modules have to be placed very close but not touching the outside surface of the primary probe where the primary induction coils are placed inside. The primary to secondary coils interface will also have to be sealed from the drilling fluid. These antenna modules must be manufactured with very tight tolerances to effectively control the primary/secondary interface gap (i.e., the distance between the primary probe and the secondary coil in the antenna module) and to seal the primary/secondary interface gap. Tight manufacturing tolerances typically results in higher costs. Thus, there is a need for an antenna module for a resistivity sub that effectively controls and seals the primary/secondary interface gap which can be manufactured with a wider range of tolerances to reduce the manufacturing costs.

SUMMARY OF THE INVENTION

Embodiments of the present invention provides methods and apparatus for communicating between surface equipment and downhole equipment.

One embodiment of the invention provides a wellhead assembly that allows electrical power and signals to pass into and out of the well during drilling operations, without removing the valve structure above the wellhead, resulting in time and cost savings. In one aspect, this embodiment provides the ability to demonstrate a DDV's performance through monitoring during drilling operations. In one embodiment, the wellhead assembly comprises a connection port disposed through a wellhead sidewall and a casing hanger disposed inside the wellhead, the casing hanger having a passageway disposed in a casing hanger sidewall, wherein a control line downhole connects to surface equipment through the passageway and the connection port.

Another embodiment of the invention provides an electromagnetic communication system for two-way communication with downhole tools that addresses the limitations of EM telemetry such as the gradual decay of EM waves as the EM waves pass through the earth's lithosphere and when a salt dome or water-bearing zone is encountered. In one aspect, the invention provides an electromagnetic casing antenna system for two-way communication with downhole tools. The electromagnetic casing antenna system is positioned downhole below the attenuating formations and is disposed in electrical contact with a sub or a DDV that is hardwired to the surface. In one embodiment the apparatus for communicating between surface equipment and downhole equipment in a well, comprises: a casing string antenna disposed on a casing string, the casing string antenna comprising a plurality of antenna cylinders, the casing string antenna disposed in electromagnetic communication with the downhole equipment; and one or more control lines operatively connected between the casing string antenna and the surface equipment.

Yet another embodiment of the invention provides an antenna module for a resistivity sub that effectively controls and seals the primary/secondary interface gap which can be manufactured with a wider range of tolerances to reduce the manufacturing costs. In one embodiment, the antenna module comprises an electromagnetic antenna module having a sealed induction interface, and the sealed induction interface comprises an elastomer seal lip.

Another embodiment provides an apparatus for drilling a well, comprising: a wellhead having a connection port disposed through a wellhead side wall; a casing hanger disposed inside the well head, the casing hanger having a passageway disposed in a casing hanger sidewall; a casing string antenna disposed on a casing string, the casing string antenna comprising a plurality of antenna cylinders; one or more control lines operatively connected between the casing string antenna and a surface equipment through the passageway in the casing hanger and the connection port in the wellhead; and an antenna module disposed downhole below the casing string antenna for communicating with the casing string antenna, the antenna module having a sealed induction interface.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Embodiments of the present invention provides methods and apparatus for communicating between surface equipment and downhole equipment. One embodiment of the invention provides a wellhead assembly that allows electrical power and signals to pass into and out of the well during drilling operations, without removing the valve structure above the wellhead, resulting in time and cost savings. Another embodiment of the invention provides an electromagnetic communication system for two-way communication with downhole tools that addresses the limitations of EM telemetry such as the gradual decay of EM waves as the EM waves pass through the earth's lithosphere and when a salt dome or water-bearing zone is encountered. Yet another embodiment of the invention provides an antenna module for a resistivity sub that effectively controls and seals the primary/secondary interface gap which can be manufactured with a wider range of tolerances to reduce the manufacturing costs.

Figure 1:
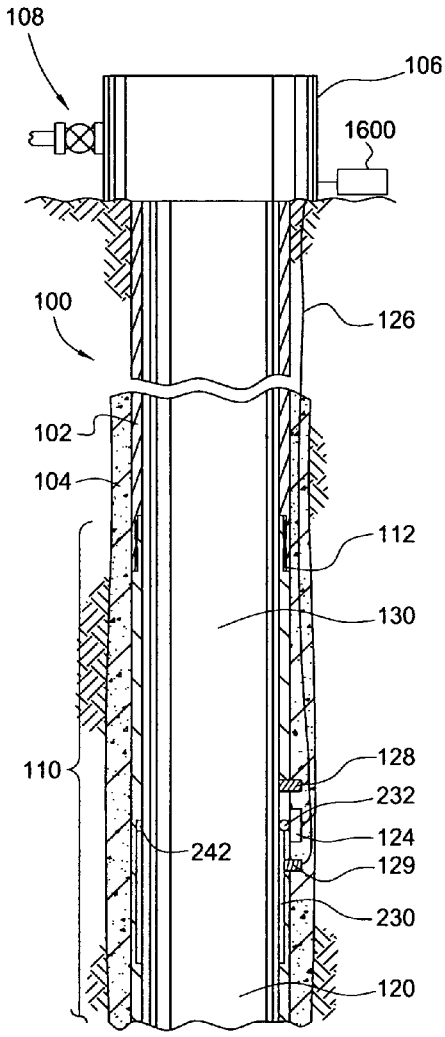
FIG. 1 is a section view of a wellbore having a casing string therein, the casing string including a downhole deployment valve (DDV).

FIG. 1 is a section view of a wellbore 100 with a casing string 102 disposed therein and held in pace by cement 104. The casing string 102 extends from a surface of the wellbore 100 where a wellhead 106 would typically be located along with some type of valve assembly 108 which controls the flow of fluid from the wellbore 100 and is schematically shown. Disposed within the casing string 102 is a downhole deployment valve (DDV) 110 that includes a housing 112, a flapper 230 having a hinge 232 at one end, and a valve seat 242 in an inner diameter of the housing 112 adjacent the flapper 230. As stated herein, the DDV 110 is an integral part of the casing string 102 and is run into the wellbore 100 along with the casing string 102 prior to cementing. The housing 112 protects the components of the DDV 110 from damage during run in and cementing. Arrangement of the flapper 230 allows it to close in an upward fashion wherein pressure in a lower portion 120 of the wellbore will act to keep the flapper 230 in a closed position. The DDV 110 also includes a surface monitoring and control unit (SMCU) 1600 to permit the flapper 230 to be opened and closed remotely from the surface of the well. As schematically illustrated in FIG. 1, the attachments connected to the SMCU 1600 include some mechanical-type actuator 124 and a control line 126 that can carry hydraulic fluid and/or electrical currents. Clamps (not shown) can hold the control line 126 next to the casing string 102 at regular intervals to protect the control line 126.

Also shown schematically in FIG. 1 is an upper sensor 128 placed in an upper portion 130 of the wellbore and a lower sensor 129 placed in the lower portion 120 of the wellbore. The upper sensor 128 and the lower sensor 129 can determine a fluid pressure within an upper portion 130 and a lower portion 120 of the wellbore, respectively. Similar to the upper and lower sensors 128, 129 shown, additional sensors (not shown) can be located in the housing 112 of the DDV 110 to measure any wellbore condition or parameter such as a position of the sleeve 226, the presence or absence of a drill string, and wellbore temperature. The additional sensors can determine a fluid composition such as an oil to water ratio, an oil to gas ratio, or a gas to liquid ratio. Furthermore, the additional sensors can detect and measure a seismic pressure wave from a source located within the wellbore, within an adjacent wellbore, or at the surface. Therefore, the additional sensors can provide real time seismic information.

Figure 2:
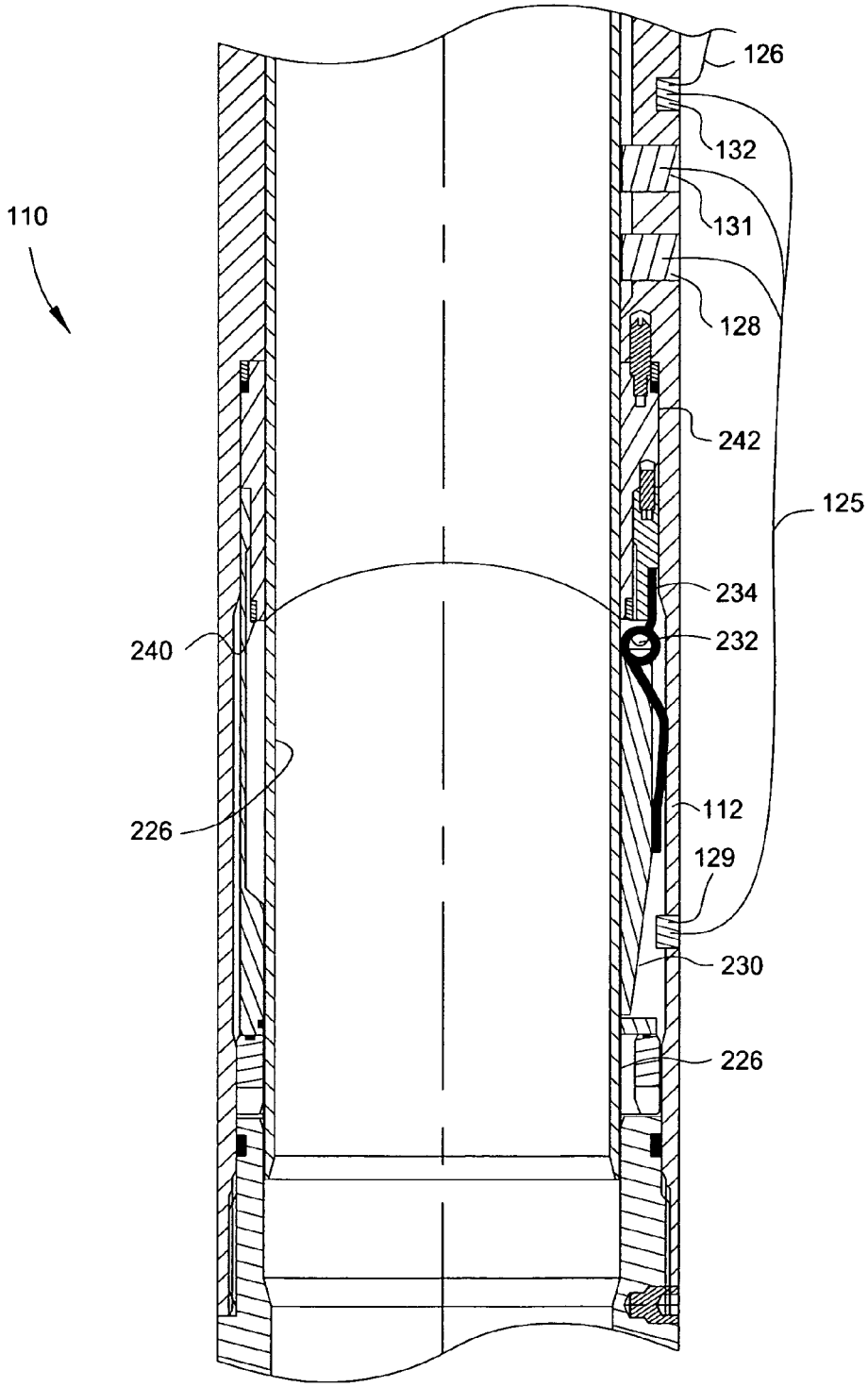
FIG. 2 is an enlarged view showing the DDV in greater detail.

FIG. 2 is an enlarged view of a portion of the DDV 110 showing the flapper 230 and a sleeve 226 that keeps it in an open position. In the embodiment shown, the flapper 230 is initially held in an open position by the sleeve 226 that extends downward to cover the flapper 230 and to ensure a substantially unobstructed bore through the DDV 110. A sensor 131 detects an axial position of the sleeve 226 as shown in FIG. 2 and sends a signal through the control line 126 to the SMCU 1600 that the flapper 230 is completely open. All sensors such as the sensors 128, 129, 131 shown in FIG. 2 connect by a cable 125 to circuit boards 132 located downhole in the housing 112 of the DDV 110. Power supply to the circuit boards 132 and data transfer from the circuit boards 132 to the SMCU 1600 is achieved via an electric conductor in the control line 126. Circuit boards 132 have free channels for adding new sensors depending on the need.

Figure 3:
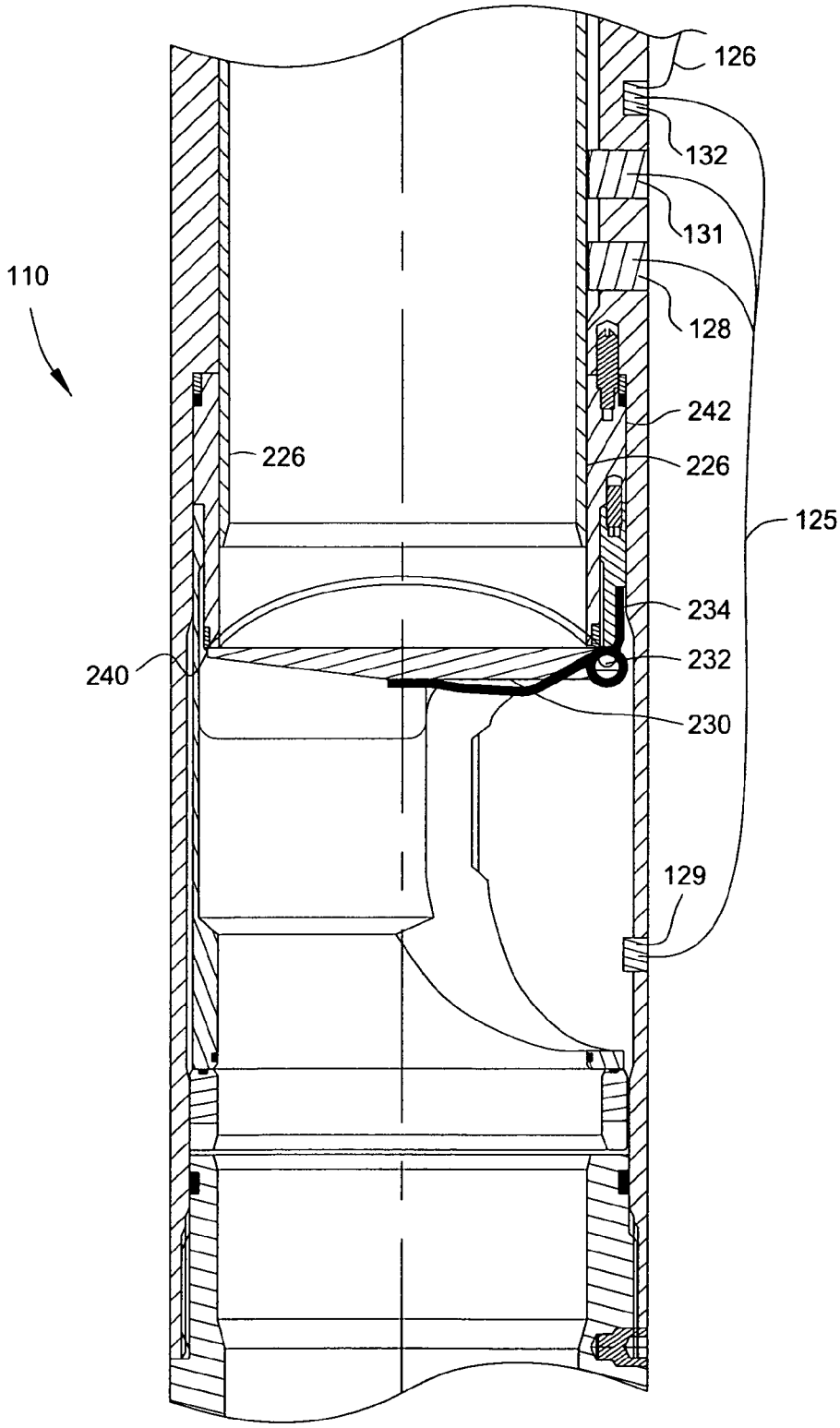
FIG. 3 is an enlarged view showing the DDV in a closed position.

FIG. 3 is a section view showing the DDV 110 in a closed position. A flapper engaging end 240 of a valve seat 242 in the housing 112 receives the flapper 230 as it closes. Once the sleeve 226 axially moves out of the way of the flapper 230 and the flapper engaging end 240 of the valve seat 242, a biasing member 234 biases the flapper 230 against the flapper engaging end 240 of the valve seat 242. In the embodiment shown, the biasing member 234 is a spring that moves the flapper 230 along an axis of a hinge 232 to the closed position. Common known methods of axially moving the sleeve 226 include hydraulic pistons (not shown) that are operated by pressure supplied from the control line 126 and interactions with the drill string based on rotational or axially movements of the drill string. The sensor 131 detects the axial position of the sleeve 226 as it is being moved axially within the DDV 110 and sends signals through the control line 126 to the SMCU 1600. Therefore, the SMCU 1600 reports on a display a percentage representing a partially opened or closed position of the flapper 230 based upon the position of the sleeve 226.

Figure 4:
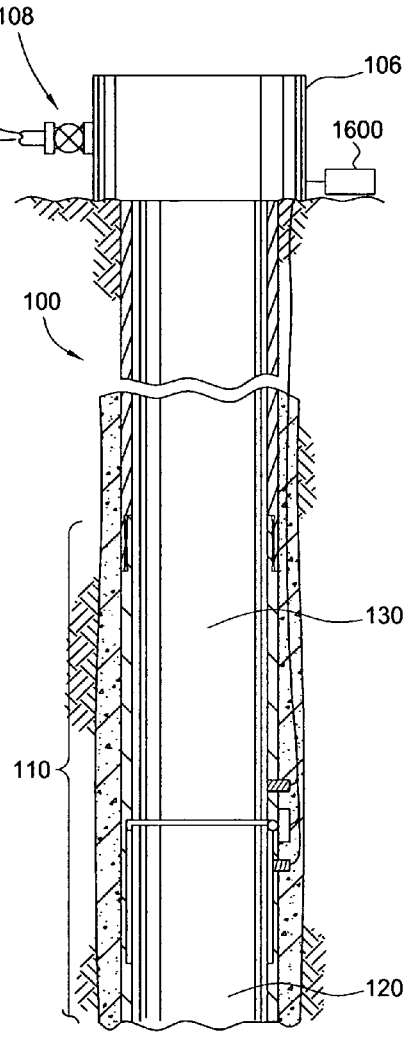
FIG. 4 is a section view of the wellbore showing the DDV in a closed position.

FIG. 4 is a section view showing the wellbore 100 with the DDV 110 in the closed position. In this position the upper portion 130 of the wellbore 100 is isolated from the lower portion 120 and any pressure remaining in the upper portion 130 can be bled out through the valve assembly 108 at the surface of the well as shown by arrows. With the upper portion 130 of the wellbore free of pressure the wellhead 106 can be opened for safely performing operations such as inserting or removing a string of tools.

Figure 5:
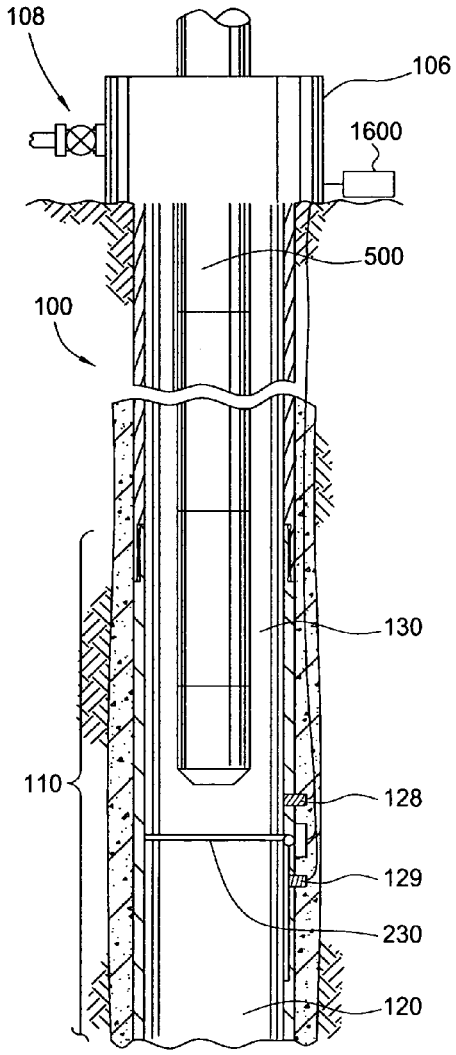
FIG. 5 is a section view of the wellbore showing a string of tools inserted into an upper portion of the wellbore with the DDV in the closed position.
Figure 6:
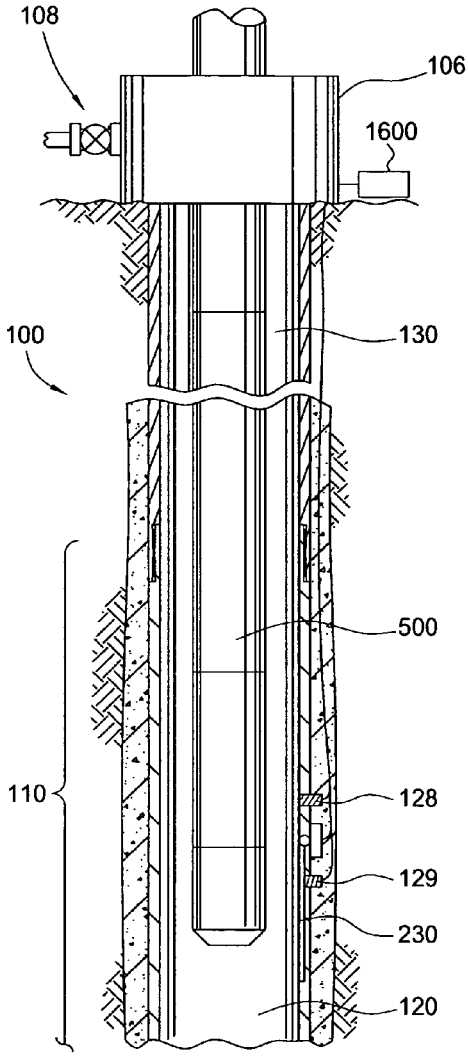
FIG. 6 is a section view of the wellbore with the string of tools inserted and the DDV opened.

FIG. 5 is a section view showing the wellbore 100 with the wellhead 106 opened and a string of tools 500 having been instated into the upper portion 130 of the wellbore. The string of tools 500 can include apparatus such as bits, mud motors, measurement while drilling devices, rotary steering devices, perforating systems, screens, and/or slotted liner systems. These are only some examples of tools that can be disposed on a string and instated into a well using the method and apparatus of the present invention. Because the height of the upper portion 130 is greater than the length of the string of tools 500, the string of tools 500 can be completely contained in the upper portion 130 while the upper portion 130 is isolated from the lower portion 120 by the DDV 110 in the closed position. Finally, FIG. 6 is an additional view of the wellbore 100 showing the DDV 110 in the open position and the string of tools 500 extending from the upper portion 130 to the lower portion 120 of the wellbore. In the illustration shown, a device (not shown) such as a stripper or rotating head at the wellhead 106 maintains pressure around the tool string 500 as it enters the wellbore 100.

Prior to opening the DDV 110, fluid pressures in the upper portion 130 and the lower portion 120 of the wellbore 100 at the flapper 230 in the DDV 110 must be equalized or nearly equalized to effectively and safely open the flapper 230. Since the upper portion 130 is opened at the surface in order to insert the tool string 500, it will be at or near atmospheric pressure while the lower portion 120 will be at well pressure. Using means well known in the art, air or fluid in the top portion 130 is pressurized mechanically to a level at or near the level of the lower portion 120. Based on data obtained from sensors 128 and 129 and the SMCU 1600, the pressure conditions and differentials in the upper portion 130 and lower portion 120 of the wellbore 100 can be accurately equalized prior to opening the DDV 110.

While the instrumentation such as sensors, receivers, and circuits is shown as an integral part of the housing 112 of the DDV 110 (See FIG. 2) in the examples, it will be understood that the instrumentation could be located in a separate "instrumentation sub" located in the casing string. The instrumentation sub can be hard wired to a SMCU in a manner similar to running a hydraulic dual line control (HDLC) cable from the instrumentation of the DDV 110 (see FIG. 16). Therefore, the instrumentation sub utilizes sensors, receivers, and circuits as described herein without utilizing the other components of the DDV 110 such as a flapper and a valve seat.

Figure 16:
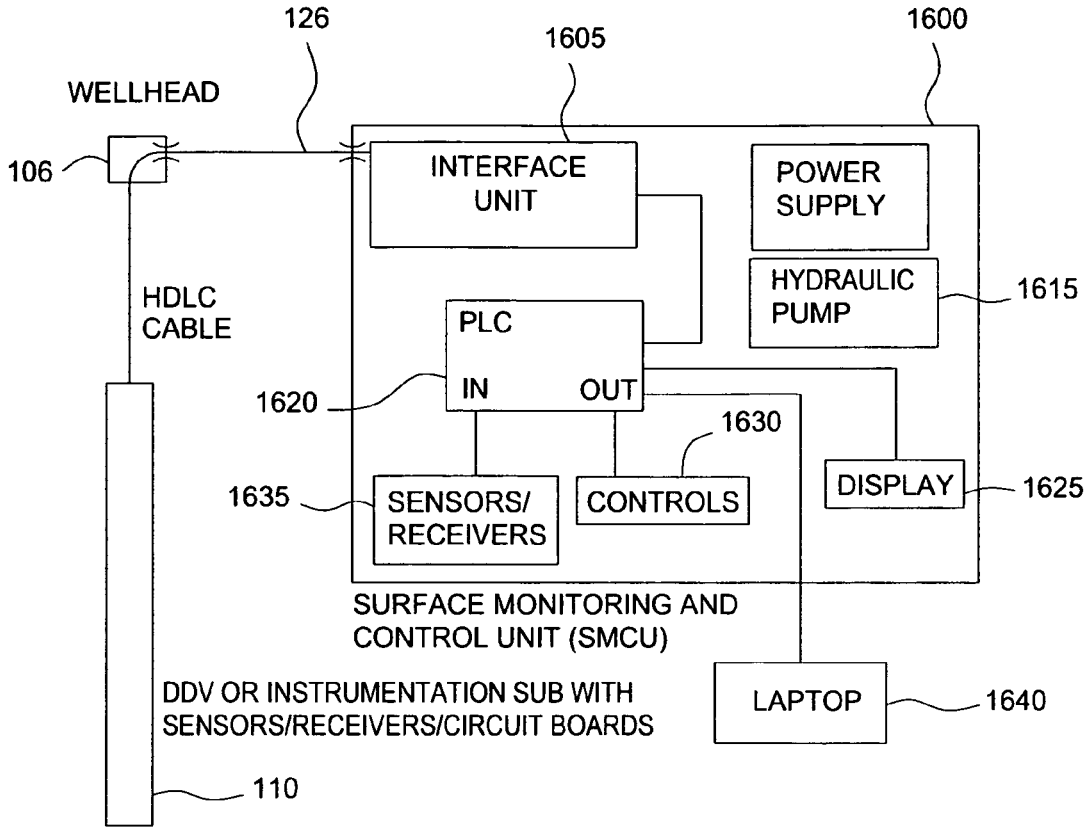
FIG. 16 is a schematic diagram of a control system and its relationship to a well having a DDV or an instrumentation sub that is wired with sensors.

FIG. 16 is a schematic diagram of a control system and its relationship to a well having a DDV or an instrumentation sub that is wired with sensors.

The figure shows the wellbore having the DDV 110 disposed therein with the electronics necessary to operate the sensors discussed above (see FIG. 1). A conductor embedded in a control line which is shown in FIG. 16 as a hydraulic dual line control (HDLC) cable 126 provides communication between downhole sensors and/or receivers 1635 and a surface monitoring and control unit (SMCU) 1600. The HDLC cable 126 extends from the DDV 110 outside of the casing string containing the DDV to an interface unit of the SMCU 1600. The SMCU 1600 can include a hydraulic pump 1615 and a series of valves utilized in operating the DDV 110 by fluid communication through the HDLC 126 and in establishing a pressure above the DDV 110 substantially equivalent to the pressure below the DDV 110. In addition, the SMCU 1600 can include a programmable logic controller (PLC) 1620 based system for monitoring and controlling each valve and other parameters, circuitry 1605 for interfacing with downhole electronics, an onboard display 1625, and standard RS-232 interfaces (not shown) for connecting external devices. In this arrangement, the SMCU 1600 outputs information obtained by the sensors and/or receivers 1635 in the wellbore to the display 1625. Using the arrangement illustrated, the pressure differential between the upper portion and the lower portion of the wellbore can be monitored and adjusted to an optimum level for opening the valve. In addition to pressure information near the DDV 110, the system can also include proximity sensors that describe the position of the sleeve in the valve that is responsible for retaining the valve in the open position. By ensuring that the sleeve is entirely in the open or the closed position, the valve can be operated more effectively. A separate computing device such as a laptop 1640 can optionally be connected to the SMCU 1600.

Figure 7:
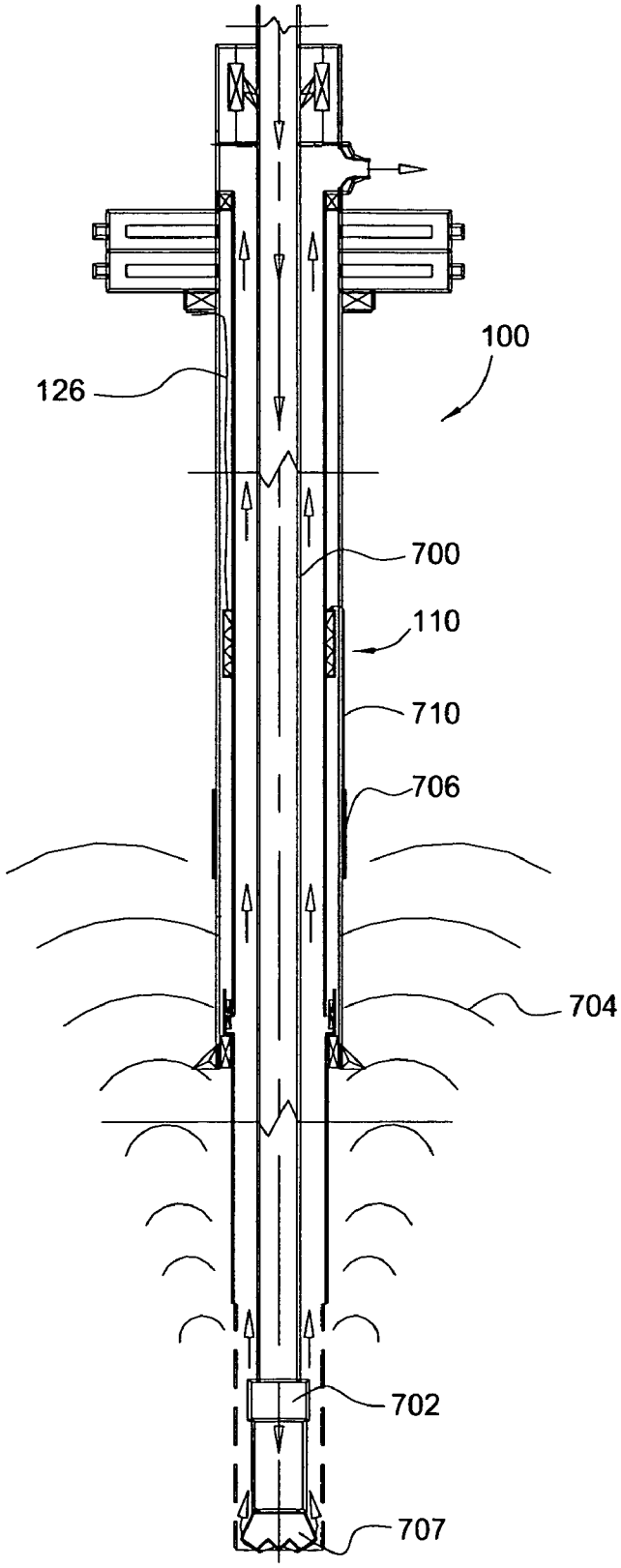
FIG. 7 is a section view of a wellbore showing the DDV of the present invention in use with a telemetry tool.

FIG. 7 is a section view of a wellbore 100 with a string of tools 700 that includes a telemetry tool 702 inserted in the wellbore 100. The telemetry tool 702 transmits the readings of instruments to a remote location by means of radio waves or other means. In the embodiment shown in FIG. 7, the telemetry tool 702 uses electromagnetic (EM) waves 704 to transmit downhole information to a remote location, in this case a receiver 706 located in or near a housing of a DDV 110 instead of at a surface of the wellbore. Alternatively, the DDV 110 can be an instrumentation sub that comprises sensors, receivers, and circuits, but does not include the other components of the DDV 110 such as a valve. The EM wave 704 can be any form of electromagnetic radiation such as radio waves, gamma rays, or x-rays. The telemetry tool 702 disposed in the tubular string 700 near the bit 707 transmits data related to the location and face angle of the bit 707, hole inclination, downhole pressure, and other variables. The receiver 706 converts the EM waves 704 that it receives from the telemetry tool 702 to an electric signal, which is fed into a circuit in the DDV 110 via a short cable 710. The signal travels to the SMCU via a conductor in a control line 126. Similarly, an electric signal from the SMCU can be sent to the DDV 110 that can then send an EM signal to the telemetry tool 702 in order to provide two way communication. By using the telemetry tool 702 in connection with the DDV 110 and its preexisting control line 126 that connects it to the SMCU 1600 at the surface, the reliability and performance of the telemetry tool 702 is increased since the EM waves 704 need not be transmitted through formations as far. Therefore, embodiments of this invention provide communication with downhole devices such as telemetry tool 702 that are located below formations containing an EM barrier. Examples of downhole tools used with the telemetry tool 702 include measurement while drilling (MWD) tools, pressure while drilling (PWD) tools, formation logging tools and production monitoring tools.

Still another use of the apparatus and methods of the present invention relate to the use of an expandable sand screen or ESS and real time measurement of pressure required for expanding the ESS. Using the apparatus and methods of the current invention with sensors incorporated in an expansion tool and data transmitted to a SMCU (see FIG. 16) via a control line connected to a DDV or instrumentation sub having circuit boards, sensors, and receivers within, pressure in and around the expansion tool can be monitored and adjusted from a surface of a wellbore. In operation, the DDV or instrumentation sub receives a signal similar to the signal described in FIG. 7 from the sensors incorporated in the expansion tool, processes the signal with the circuit boards, and sends data relating to pressure in and around the expansion tool to the surface through the control line. Based on the data received at the surface, an operator can adjust a pressure applied to the ESS by changing a fluid pressure supplied to the expansion tool.

Figure 8:
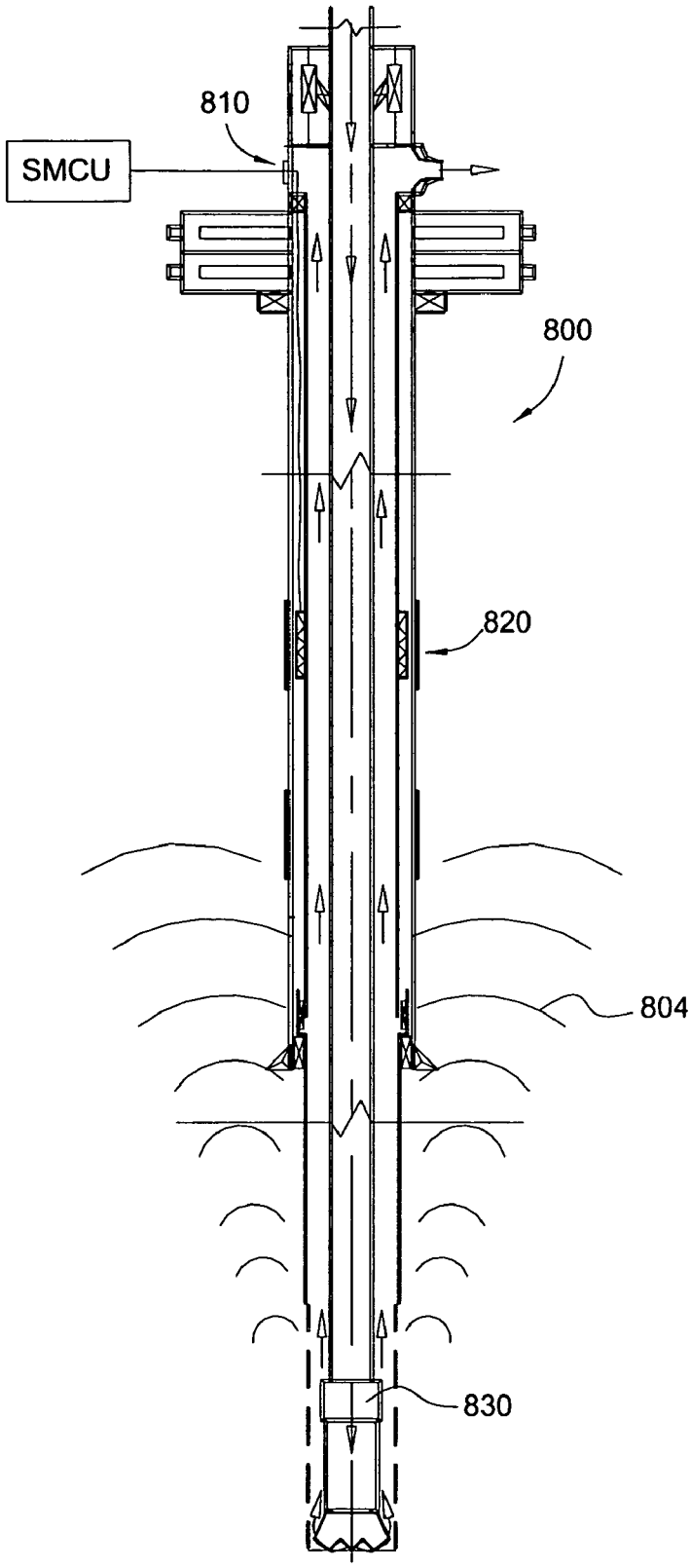
FIG. 8 is a section view of a wellbore illustrating one embodiment of a system for communicating between surface equipment and downhole equipment.

FIG. 8 is a section view of a wellbore illustrating one embodiment of a communication system 800 for communicating between surface equipment and downhole equipment. The communication system 800 includes a wellhead assembly 810 that allows electrical power and signals to pass into and out of the well during drilling operations, without removing the valve structure above the wellhead. The communication system 800 also includes an electromagnetic casing antenna system 820 for two-way communication with downhole tools. Communication with downhole tools may be accomplished through electromagnetic waves 804. The downhole tools may include a resistivity sub 830 having a plurality of antenna modules for transmitting and receiving EM signals with the electromagnetic casing antenna system 820. One embodiment of the invention provides an antenna module for a resistivity sub that effectively controls and seals an interface gap between a primary coil in a probe and a secondary coil (or coupling coil) in the antenna module of the resistivity sub.

Wellheád Penetration Assembly

One embodiment of the invention provides a wellhead assembly that allows electrical power and signals to pass into and out of the well during drilling operations, without removing the valve structure above the wellhead, resulting in time and cost savings. The wellhead assembly provides a hardwire feed-through without subverting the wellhead pressure integrity. In one aspect, this embodiment provides the ability to demonstrate a DDV's performance through monitoring during drilling operations.

Figure 9:
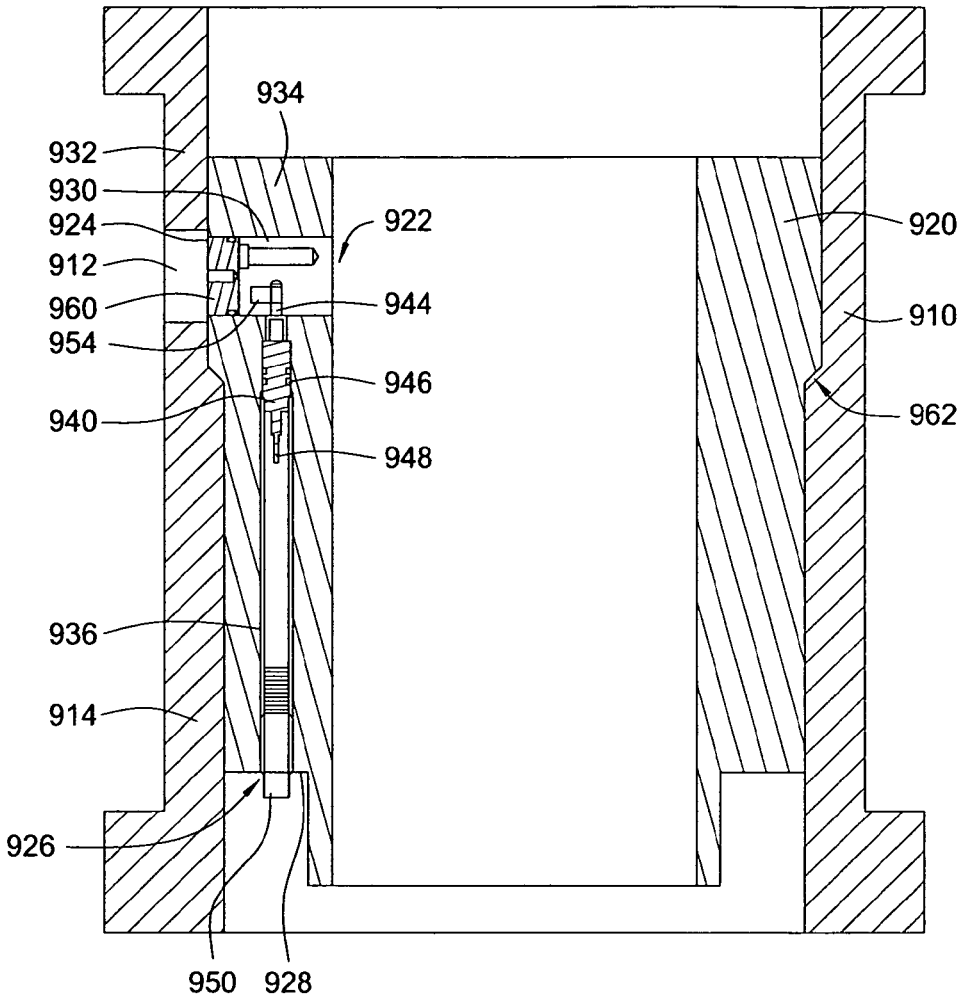
FIG. 9 is a sectional view of one embodiment of a wellhead 910 and a casing hanger 920.

FIG. 9 is a sectional view of one embodiment of a wellhead 910 and a casing hanger 920 having a connection port. The wellhead 910 and casing hanger 920 facilitates passing electrical power and signals through the wellhead assembly during drilling operations. The wellhead 910 represents one embodiment which may be utilized with a DDV such as the wellhead assembly 810 shown in FIG. 8. The wellhead 910 includes a connection port 912 disposed laterally through a wall portion 914 of the wellhead 910. The connection port 912 is located in a position such that a passage may be aligned with the connection port 912 when the casing hanger 920 is inserted into the wellhead 910.

The casing hanger 920 includes a passage 922 which facilitates connection of electrical power and signals from electrical equipment below the surface during drilling operations. The passage 922 includes a first opening 924, which may be aligned with the connection port 912 on the wellhead 910, and a second opening 926, which is located on a lower or bottom surface 928 of the casing hanger 920. In one embodiment, the passage 922 may be made in the casing hanger 920 by making a first bore 930 from an outer surface 932 of the casing hanger 920 to a depth without penetrating through the wall portion 934 of the casing hanger 920 and making a second bore 936 from the bottom surface 928 of the casing hanger 920 to intersect the first bore 930.

A connector 940 may be inserted through the second opening 926 on the bottom surface 928 of the casing hanger 920 and disposed at a top portion of the second bore 936. The connector 940 may include a tip portion 944 which protrudes into the first bore 930 and facilitates connection to other cables/connectors disposed through the connection port 912 and the first opening 924. One or more fasteners 946, such as O-rings, gaskets and clamps, may be disposed between the connector 940 and the second bore 936 to provide a seal and to hold the connector 940 in place. The connector 940 may include a lower connector terminal or tip 948 for connecting with a cable or line from down hole (e.g., control line 126). A threaded insert 950 may be disposed through the second opening 926 and positioned at a bottom portion of the second bore 936. The threaded insert 950 may be utilized to receive and secure a cable or line from down hole to the passage 922. Another connector part or connector terminal 954 may be inserted through the first opening 924 and disposed in connection with the tip portion 944 which protrudes into the first bore 930 to facilitate connection to other cables/connectors disposed through the connection port 912 and the first opening 924.

A debris seal 960 is disposed in the first bore 930 and covers the first opening 924 to keep the connector parts (e.g., the connector 940 and the connector terminal 954) clean and free from dirt, grease, oil and other contaminating materials. The debris seal 960 may be removed through the connection port 912 after the casing hanger 920 has been installed into the wellhead 910 and ready to be connected to cables/lines from the surface equipment. The debris seal 960, the connector 940, the threaded insert 950 and the connector terminal 954 are installed in the casing hanger 920 prior to lowering the casing hanger 920 into the wellhead 910.

The casing hanger 920 may be aligned into the wellhead 910 in a desired orientation utilizing alignment features 962 disposed on an outer surface of the casing hanger 920 and an inner surface of the wellhead 910. For example, a wedge may be disposed on an inner surface of the wellhead 910 and a matching receiving slot may be disposed on an outer surface of the casing hanger 920 such that as the casing hanger 920 is inserted into the wellhead 910, the wedge engages the receiving slot and rotates the casing hanger 920 into the desired orientation. In the desired orientation, the first opening 924 is aligned with the connection port 912, and control lines to the surface equipment may be connected through the connection port 912.

Casing Antenna System EM Casing Antenna System for Two-Way Communication with Downhole Tools One embodiment of the invention provides an electromagnetic communication system for two-way communication with downhole tools that addresses the limitations of EM telemetry such as the gradual decay of EM waves as the EM waves pass through the earth's lithosphere and when a salt dome or water-bearing zone is encountered. In one aspect, the invention provides an electromagnetic casing antenna system for two-way communication with downhole tools.

Figure 10C:
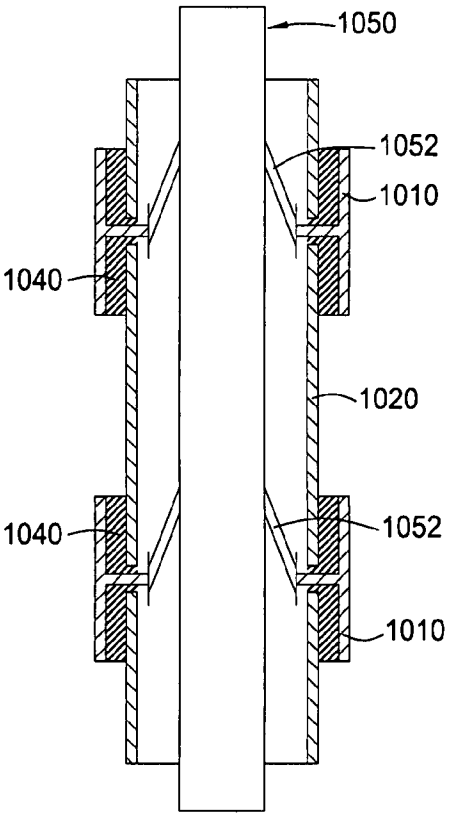
FIGS. 10A-C illustrate one embodiment of an EM casing antenna system 1000 having ported contacts which can be utilized with a DDV system.
Figure 10B:
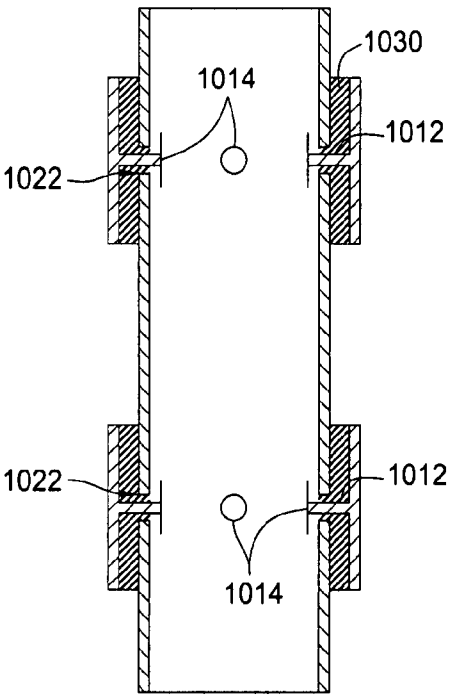
Figure 10A:
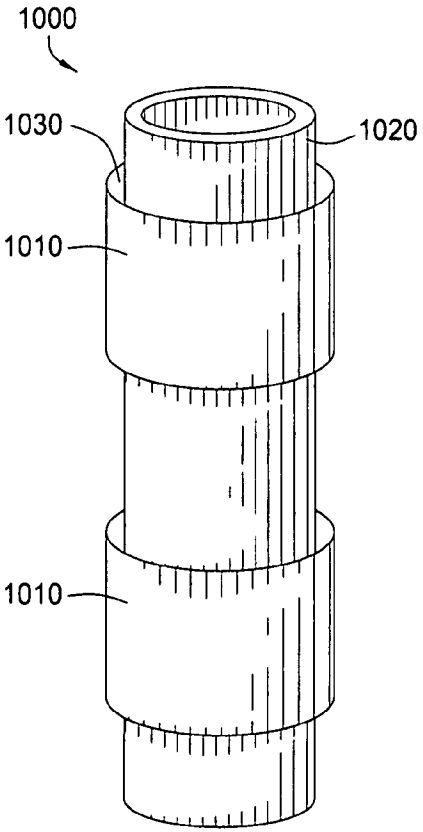

FIGS. 10A-C illustrate one embodiment of an EM casing antenna system 1000 having ported contacts which can be utilized with a DDV system. Although embodiments of the EM casing antenna system are described as utilized with a DDV system, it is contemplated that the EM casing antenna system may be utilized with a variety of other downhole components or systems having a wireline-to-surface electrical connection. The EM casing antenna system 1000 serves as an interface between a wireline-to-surface link (e.g., DDV system) and a downhole system (e.g., EM telemetry system). Utilizing the EM casing antenna system 1000 with a DDV system shortens the path over which the radiated EM signal from the downhole telemetry system must travel, thus lessening the attenuation of the radiated EM signal. This is particularly advantageous where the DDV system and the associated casing penetrate below lossy rock formations that might otherwise render the EM link ineffective. In one embodiment, the EM casing antenna 1000 is disposed downhole as part of the outer casing string in the form of an antenna sub. Alternatively, the EM casing antenna system 1000 can be a part of the same casing string that contains the DDV if the EM casing antenna system 1000 could be located in the open hole (i.e., not inside another casing string).

FIG. 10A is an external side view of a casing joint having one embodiment of the EM casing antenna system 1000. The EM casing antenna system 1000 comprises two metallic antenna cylinders 1010 that are mounted coaxially onto a casing joint 1020. The two metallic antenna cylinders 1010 may be substantially identical. The casing joint 1020 may be selected from a desired standard size and thread and may be modified for the EM casing antenna system 1000 to be mounted thereon.

In one embodiment, two sets of holes 1022 are drilled through the cylindrical wall portion of the casing joint 1020 to facilitate mounting the antenna cylinders 1010 onto the casing joint. Each set of holes 1022 may be disposed substantially equally about a circumference of the casing joint 1020. A corresponding set of mounting bars 1012 may be disposed on (e.g., fastened, welded, threaded or otherwise secured onto) an inner surface of the antenna cylinders 1010 and protrude into the set of holes 1022 on the casing joint 1020. A contact plate 1014 is disposed on a terminal end of each mounting bar 1012. The mounting bars 1012 and the contact plates 1014 are insulated from casing joint wall. In one embodiment, the contact plates 1014 have very low profiles with very little or no protrusion into the interior of the casing joint 1020. An interstitial space 1030 exists between the antenna cylinders 1010 and the casing joint 1020, and the interstitial space 1030 is filled with an insulating material 1040 whose mechanical integrity will prevent leakage through the apertures (holes) cut in the casing joint wall.

The arrangement of the antenna cylinders 1010 as shown in FIG. 10A can be used to form an electric dipole whose axis is coincident with the casing. To increase the effectiveness of the dipole, the surface area of the cylinders and the spacing between them can be increased or maximized. The antenna cylinders can act as both transmitter and receiver antenna elements. The antenna cylinders may be driven (transmit mode) and amplified (receive mode) in a full differential arrangement, which results in increased signal-to-noise ratio, along with improved common mode rejection of stray signals.

In one embodiment, the EM casing antenna system 1000 is utilized with a DDV 1050 which includes a plurality of swing arms 1052 (e.g., two sets of swing arms) for making electrical contacts with the contact plates 1014. Each swing arm 1052 may include a contact tip that may be mated to a contact plate 1014. The contact tips may include elastomeric face seals around the electrical contact surfaces. When the electrical contact surfaces on the swing arms 1052 engage the contact plates 1014 of the antenna cylinders 1010, the elastomeric face seals are pressed against the contact plates 1014 and isolate the electrical contact from surrounding fluids. An orientation guide or feature (not shown) may be utilized to ensure that the swing arms are properly oriented to contact the contact plates. To ensure a high quality electrical contact between the swing arms and the contact plates, a micro-volume piston (not shown) may be utilized to flush the electrical contact surfaces on the swing arm against the contact plate as the seal is made.

The EM casing antenna system downhole electronics may be incorporated into in a DDV. Alternatively, the EM casing antenna system downhole electronics may be incorporated into a retrievable instrument sub that can be latched into a casing string at a predetermined depth. In this case, the retrievable instrument sub is hardwired to the surface equipment (e.g., SMCU) in a manner similar to running HDLC cable from instrumented DDV. As another alternative, the EM casing antenna system downhole electronics may be incorporated as a permanent installation connected to the EM casing antenna system 1000. Optionally, an EM receiver preamplifier as well as a full decoding circuitry may be contained in the DDV assembly to condition the received signals fully before wire-relayed to the surface. The EM casing antenna system 1000 is positioned downhole below the natural formation barriers to provide improved signals from the telemetry system to the surface equipment.

Figure 11C:
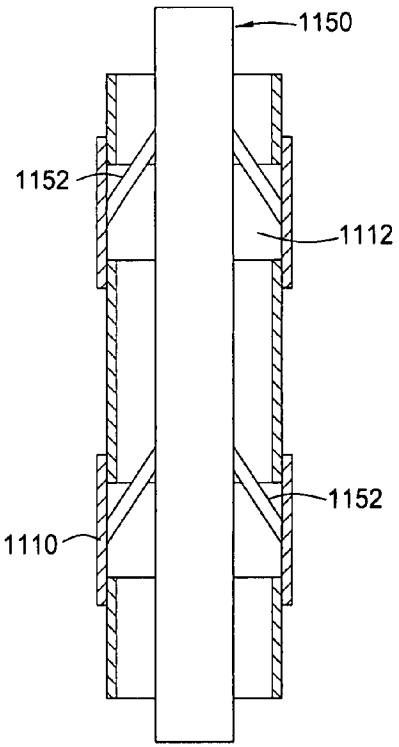
FIGS. 11A-C illustrate another embodiment of an EM casing antenna system 1100 having circumferential contacts which can be utilized with a DDV system.
Figure 11B:
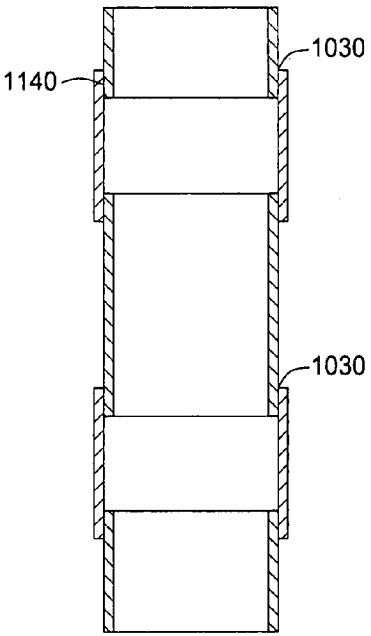
Figure 11A:
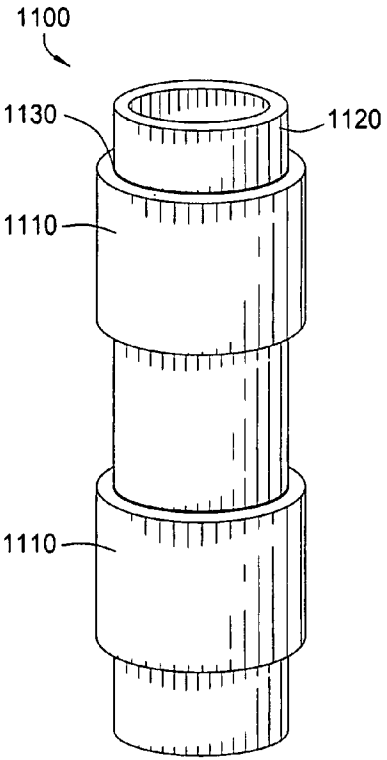

FIGS. 11A-C illustrate another embodiment of an EM casing antenna system 1100 having circumferential contacts which can be utilized with a DDV system. As shown in FIGS. 11A and 11B, the EM casing antenna system 1100 includes two antenna cylinders 1110 disposed on a three-segment casing joint 1120. The antenna cylinders 1110 serve as connections between the casing joint segments. An interstitial space 1130 exists between the antenna cylinders 1110 and the casing joint 1120 where they overlap, and the interstitial space 1130 is filled with an insulating material 1140 whose mechanical integrity will prevent leakage through the interstitial space. Similar to the embodiment described with reference to FIGS. 10A-C, the antenna cylinders 1110 form an electric dipole whose axis is coincident with the casing. As shown in FIG. 11C, an entire circumference of an inner surface 1112 of each antenna cylinder may be engaged by the electrical contact surfaces on the swing arms 1152 of the DDV 1150, and this arrangement allows the swing arms 1152 to contact the antenna cylinders 1110 in any orientation (i.e., without having to align the swing arms in a particular orientation). The electrical contact surfaces and the swing arms may take on a variety of shapes, forms and contact geometries.

Figure 12C:
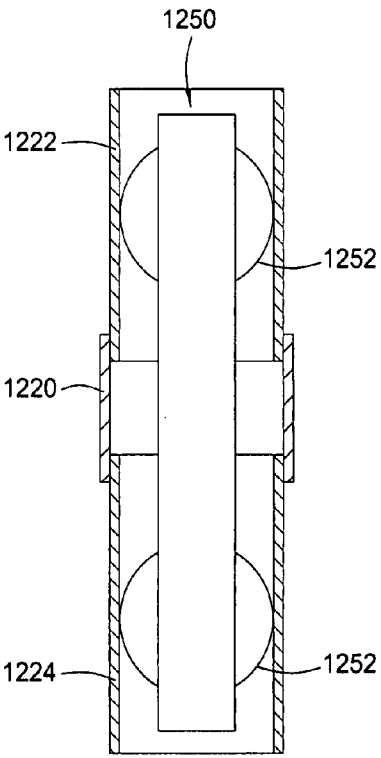
FIGS. 12A-C illustrate another embodiment of an EM casing antenna system 1200 which can be utilized with another embodiment of a DDV system 1210.
Figure 12B:
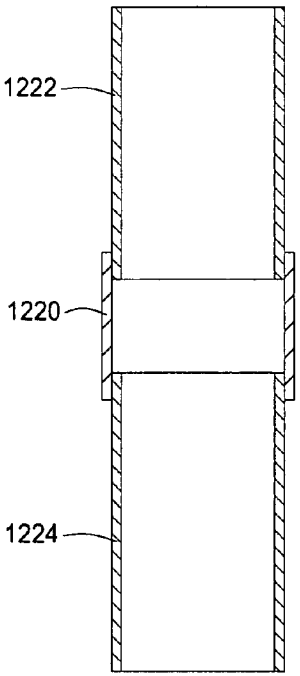
Figure 12A:
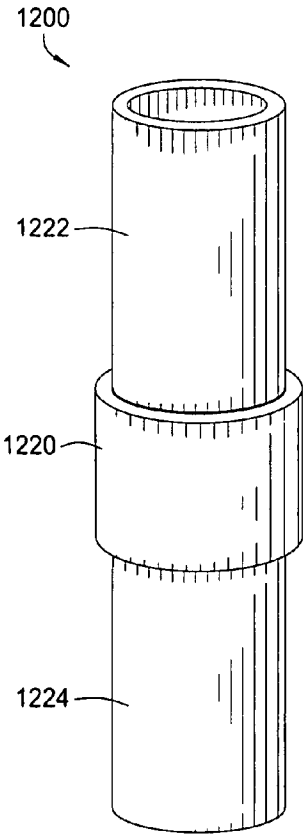

FIGS. 12A-C illustrate another embodiment of an EM casing antenna system 1200 which can be utilized with another embodiment of a DDV system 1250. In this embodiment, as shown in FIGS. 12A and 12B, an insulating collar 1220 is disposed between two standard casing joints 1222, 1224 which are utilized as the antenna of the EM casing antenna system 1200. The insulating collar 1220 may be made of an insulating composite material that would be inherently isolative. Alternatively, the insulating collar 1220 may be made of a metallic alloy whose surface are treated with an insulator coating. To avoid potential problems with thin insulating layers which may present a large capacitive load to the dipole antenna, a large, bulk insulator may be utilized as the material for the insulating collar 1220. As shown in FIG. 12C, the DDV system 1250 in this embodiment includes two sets of bowsprings 1252 which provide the electrical contact surfaces for contacting the interior surfaces of the casing joints 1222, 1224. The electrical contact surfaces on the bowsprings 1252 may be treated to increase the surface roughness which ensures that any scale, paraffin or other buildup is penetrated for making good electrical connection to the interior surface of the casing joint. As an alternative embodiment, a plurality of casing joints may be isolated utilizing a plurality of insulating collars, and the outermost casing joints may be utilized as the antenna dipoles.

Embodiments of the EM casing antenna system associated with a DDV or an instrument sub provide reliable transmission of EM signal from downhole tools despite the presence of natural barriers such as salt domes and water-bearing zones. The EM casing antenna systems also alleviate problems of signal degradation in EM telemetry for directional drilling in underbalanced jobs and increases the operating range of EM telemetry systems. The casing-deployed antenna system may communicate with a DDV assembly or other casing-deployed instrument system utilizing physical contact components, or alternatively, utilizing non-contact medium such as hydraulic, inductive, magnetic and acoustic medium.

Antenna Module Induction Interface

Resistivity subs are utilized to transmit and receive welbore signals via a number of antenna modules. One embodiment of the invention provides an antenna module for a resistivity sub that effectively controls and seals the primary/secondary interface gap which can be manufactured with a wider range of tolerances to reduce the manufacturing costs.

Figure 13:
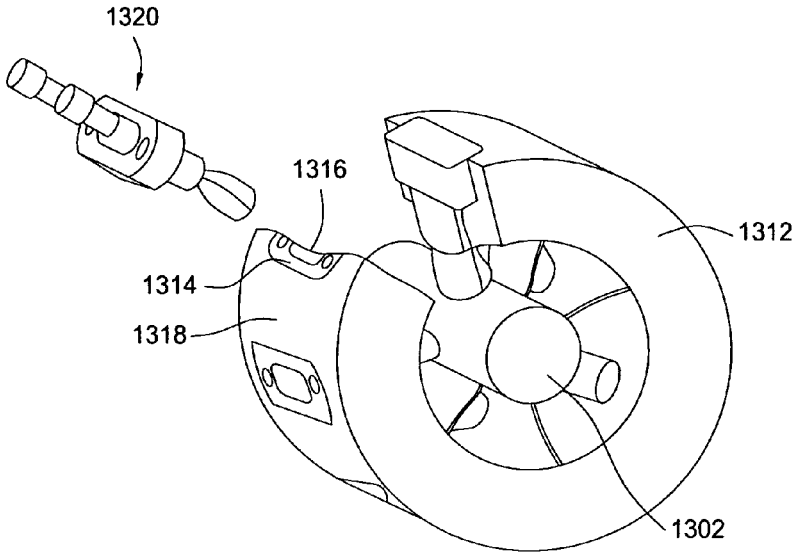
FIG. 13 is an exploded cut-away view of a drill collar fitted with a plurality of antenna modules according to one embodiment of the invention.
Figure 15:
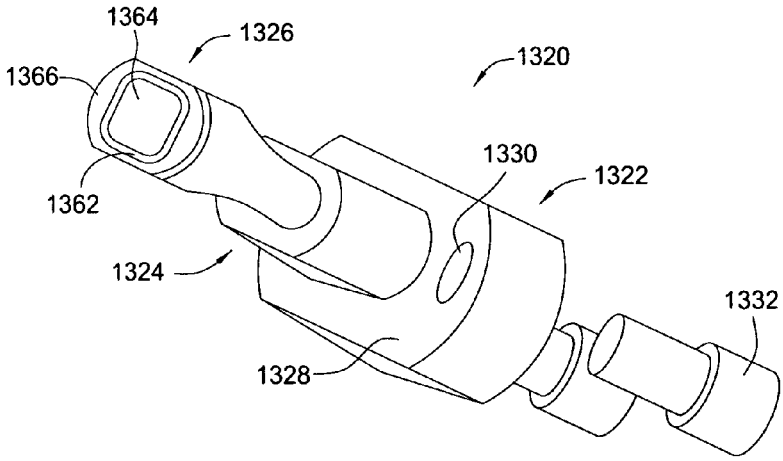
FIG. 15 is a perspective view of an antenna module 1320.
Figure 14:
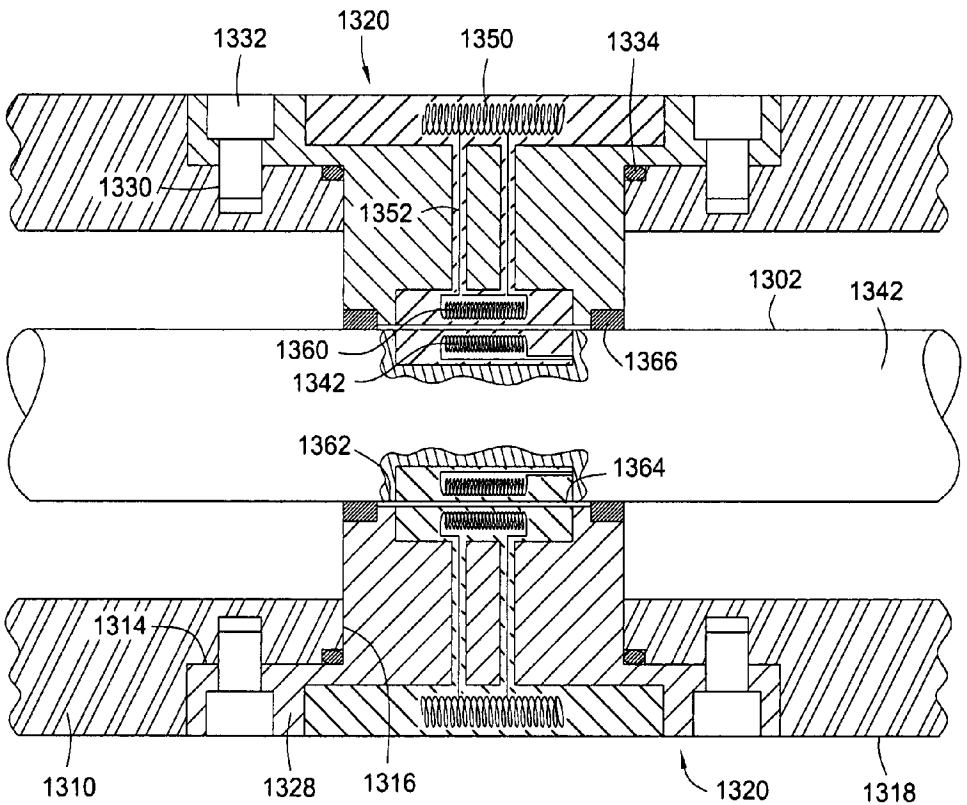
FIG. 14 is a cross sectional view of one embodiment of an antenna module 1320 (two shown) installed on a drill collar 1310.

FIG. 13 is an exploded cut-away view of a drill collar fitted with a plurality of antenna modules according to one embodiment of the invention. FIG. 14 is a cross sectional view of one embodiment of an antenna module 1320 (two shown) installed on a drill collar 1310. FIG. 15 is a perspective view of an antenna module 1320. Referring to FIGS. 13-15, the drill collar 1310 generally comprises a cylindrical body 1312 having a plurality of recesses 1314 and holes 1316 bored out from an outer surface 1318 of the cylindrical body 1312 to accommodate a plurality of antenna modules 1320. The antenna module 1320 includes an outer portion 1322, a middle portion 1324 and an inner portion 1326. The outer portion 1322 includes a flange 1328 which fits flushly into a recess 1314 on the drill collar 1310. The flange 1328 includes one or more fastener holes 1330 which allow one or more fasteners 1332 to secure the antenna module into the recess 1314 on the drill collar 1310. In one embodiment, the fasteners 1332 comprise non-magnetic cap screws that incorporate self-locking threads (e.g., Spiralock®). An O-ring 1334 may be disposed between a surface of the recess 1314 and the flange 1328 to provide a seal between the antenna module 1320 and the drill collar 1310.

A primary probe 1302 is also shown in FIGS. 13 and 14. The primary probe 1302 is disposed axially through the drill collar 1310 and includes one or more primary induction coils 1342. The antenna module 1320 includes an antenna coil 1350 disposed in an outer portion 1322 and a secondary coil 1360 disposed in an inner portion 1326. The antenna coil 1350 is connected to the secondary coil 1360 through electrical wires 1352 which are disposed through the middle portion 1324 of the antenna module 1320. The antenna coil 1350 may be utilized to receive and transmit signals through the wellbore, and the secondary coil 1360 facilitate transferring signals between the antenna coil 1350 and the primary coils 1342 in the primary probe 1302. In a signal sending operation, the antenna coil 1350, acting as a sending antenna, receives electrical signals from the primary induction coils 1342 through the secondary coil 1360 and sends the electrical signals through the wellbore to other equipment in the wellbore and at the surface. In a receiving operation, the antenna coil 1350, acting as a receiving antenna, receives electrical signals through the wellbore from other equipment in the wellbore and/or at the surface and sends the electrical signals to the primary induction coils 1342 through the secondary coil 1360.

One aspect of the invention improves the control over the primary/secondary interface gap and provides for sealing the primary/secondary interface from the drilling fluids. In one embodiment, the secondary coil 1360 is disposed in the inner portion 1326 of the antenna module and sealed with epoxy, and the epoxy surface 1364 is ground flush with the raised metallic lip 1362. An elastomer 1366 is vulcanized to shape a sealing lip around the contact area. The elastomer face extends about 0.015 to 0.030 inches higher than the face of the raised metallic lip, which allows compression of the elastomer 1366 and sealing of the interface between the primary coil 1342 and the secondary coil 1360. The elastomer 1366 also serves as a shock absorbing element which dampens out the drill string vibration. The depths of the drill collar recesses 1314, the heights of the antenna inner faces (i.e., the epoxy surface 1364 and the surface of the raised metallic lip 1362) and the diameter of the primary probe 1302 are dimensionally fitted to maintain 0.010 inch maximum gaps.

While the foregoing is directed to embodiments of the present invention, other and further embodiments of the invention may be devised without departing from the basic scope thereof, and the scope thereof is determined by the claims that follow.

The invention claimed is:

1. An apparatus for drilling a well, comprising:

a wellhead having a connection port disposed through a wellhead side wall;

a casing hanger disposed inside the wellhead, the casing hanger having a passageway disposed in a casing hanger sidewall;

a casing string antenna disposed on a casing string, the casing string antenna comprising a plurality of antenna cylinders;

one or more control lines operatively connected between the casing string antenna and surface equipment through the passageway in the casing hanger and the connection port in the wellhead; and an antenna module disposed downhole below the casing string antenna for communicating with the casing string antenna, the antenna module having a sealed induction interface.

2. The apparatus of claim 1, further comprising:

one or more connectors disposed in the passageway for connecting to the control line.

3. The apparatus of claim 1 wherein the passageway is formed by a first bore from a bottom surface of the casing hanger intersecting a second bore from a sidewall surface of the casing hanger.

4. The apparatus of claim 3, further comprising:

a removable debris seal disposed in the second bore in the casing hanger.

5. The apparatus of claim 1, further comprising:

an alignment feature disposed cooperatively on the casing hanger and the wellhead sidewall to align the casing hanger in the wellhead.

6. The apparatus of claim 5, wherein the alignment feature comprises one or more wedges disposed on the casing hanger and one or more receiving slots disposed on the wellhead for rotating the casing hanger into alignment in the wellhead.

7. The apparatus of claim 1 wherein the one or more control lines are operatively connected between the casing string antenna and the surface equipment through a downhole deployment valve.

8. The apparatus of claim 1 wherein the one or more control lines are operatively connected between the casing string antenna and the surface equipment through an instrument sub.

9. The apparatus of claim 1 wherein the antenna cylinders are two metallic cylinders insulated by insulating material to form a dipole antenna.

10. The apparatus of claim 1 wherein the antenna cylinders include contact plates extending through apertures in the casing string.

11. The apparatus of claim 1 wherein the antenna cylinders include an interior circumferential electrical surface.

12. The apparatus of claim 1 wherein the antenna cylinders comprise casing joints insulated by insulation joints.

13. The apparatus of claim 1 wherein the antenna module comprises an antenna coil disposed in an outer portion and a secondary coil disposed in an inner portion.

14. The apparatus of claim 13 wherein the sealed induction interface comprises an elastomer seal lip.

15. The apparatus of claim 14 wherein the elastomer seal lip is disposed around a metallic lip surrounding the secondary coil.

16. The apparatus of claim 1 wherein the antenna module includes a flange for mounting on a drill collar.

17. The apparatus of claim 16 wherein the antenna module is mounted utilizing non-magnetic screws having self-locking threads.

18. An apparatus for drilling a well, comprising:

a wellhead having a connection port disposed through a wellhead sidewall;

a casing hanger disposed inside the wellhead, the casing hanger having a passageway disposed in a casing hanger sidewall, wherein a control line downhole connects to surface equipment through the passageway and the connection port; and a removable debris seal disposed in the casing hanger.

19. The apparatus of claim 18 wherein the passageway is formed by a first bore from a bottom surface of the casing hanger intersecting a second bore from a sidewall surface of the casing hanger.

20. The apparatus of claim 19, further comprising:

one or more connectors disposed in the passageway for connecting to the control line.

21. The apparatus of claim 18, further comprising:

an alignment feature disposed cooperatively on the casing hanger and the wellhead sidewall to align the casing hanger in the wellhead.

22. The apparatus of claim 21, wherein the alignment feature comprises one or more wedges disposed on the casing hanger and one or more receiving slots disposed on the wellhead for rotating the casing hanger into alignment in the wellhead.

23. An apparatus for communicating between surface equipment and downhole equipment in a well, comprising:

a casing string antenna disposed on a casing string, the casing string antenna comprising a plurality of antenna cylinders, the casing string antenna disposed in electromagnetic communication with the downhole equipment; and one or more control lines operatively connected between the casing string antenna and the surface equipment.

24. The apparatus of claim 23 wherein the one or more control lines are operatively connected between the casing string antenna and the surface equipment through a downhole deployment valve.

25. The apparatus of claim 23 wherein the one or more control lines are operatively connected between the casing string antenna and the surface equipment through an instrument sub.

26. The apparatus of claim 23 wherein the antenna cylinders are two metallic cylinders insulated by insulating material to form a dipole antenna.

27. The apparatus of claim 23 wherein the antenna cylinders include contact plates extending through apertures in the casing string.

28. The apparatus of claim 23 wherein the antenna cylinders include an interior circumferential electrical surface.

29. The apparatus of claim 23 wherein the antenna cylinders comprise casing joints insulated by insulation joints.

30. The apparatus of claim 23, wherein the casing string is secured in the well by cement.

31. An antenna module for communicating in a well, comprising:

an antenna coil disposed in an outer portion and a secondary coil disposed in an inner portion; and a sealed induction interface, wherein:

the sealed induction interface comprises an elastomer seal lip, and the elastomer seal lip is disposed around a metallic lip surrounding the secondary coil.

32. The apparatus of claim 31 further comprising a flange for mounting on a drilling collar.

33. An apparatus, comprising:

the antenna module of claim 32;

the drill collar, wherein the antenna module is mounted on the drill collar with the flange, the flange having fastener holes disposed therethrough; and non-magnetic screws having self-locking threads, each screw disposed in a respective fastener hole.

34. An apparatus for communicating in a well, comprising:

an antenna module comprising a sealed induction interface and a flange;

a drill collar, wherein the antenna module is mounted on the drill collar with the flange, the flange having fastener holes disposed therethrough; and non-magnetic screws having self-locking threads, each screw disposed in a respective fastener hole.

35. The apparatus of claim 34, wherein the antenna module comprises an antenna coil disposed in an outer portion and a secondary coil disposed in an inner portion.

36. The apparatus of claim 35, wherein the sealed induction interface comprises an elastomer seal lip.

37. An apparatus for communicating between surface equipment and downhole equipment in a well, comprising:

a casing string disposed in the well, the casing string comprising an antenna;

a downhole deployment valve disposed in the well;

one or more control lines in communication with the casing string antenna, the downhole deployment valve, and the surface equipment;

a tool string extending through the casing string, the tool string comprising an antenna; and the surface equipment located at a surface of the well.

38. The apparatus of claim 37, wherein the casing string is secured in the well by cement.

39. The apparatus of claim 37, wherein the tool string is a drill string comprising a drill bit.

40. The apparatus of claim 39, wherein the drill string further comprises a pressure sensor in communication with the drill string antenna.

41. A method for communicating between surface equipment and downhole equipment in a well, comprising:

providing the apparatus of claim 40;

drilling the well using the drill string and the drill bit;

while drilling, measuring pressure in the well using the pressure sensor;

while drilling, transmitting the pressure measurement from the tool string antenna;

while drilling, receiving the pressure measurement at the casing string antenna; and while drilling, sending the pressure measurement to the surface equipment via the control lines.

42. The apparatus of claim 37, further comprising:

a wellhead having a connection port disposed through a wellhead sidewall, wherein the casing string further comprises a casing hanger disposed inside the wellhead, the casing hanger having a passageway disposed in a casing hanger sidewall, wherein the control lines connect to the surface equipment through the passageway and the connection port.

43. The apparatus of claim 42, wherein the passageway is formed by a first bore from a bottom surface of the casing hanger intersecting a second bore from a sidewall surface of the casing hanger.

44. The apparatus of claim 43, further comprising:

one or more connectors disposed in the passageway for connecting to the control lines.

45. The apparatus of claim 42, further comprising a removable debris seal disposed in the casing hanger.

46. The apparatus of claim 42, further comprising:

an alignment feature disposed cooperatively on the casing hanger and the wellhead sidewall to align the casing hanger in the wellhead.

47. The apparatus of claim 46, wherein the alignment feature comprises one or more wedges disposed on the casing hanger and one or more receiving slots disposed on the wellhead for rotating the casing hanger into alignment in the wellhead.

48. The apparatus of claim 37, wherein the downhole deployment valve is part of the case string.

49. The apparatus of claim 37, wherein the downhole deployment valve comprises a sensor.

50. The apparatus of claim 37, wherein the casing string antenna comprises a plurality of antenna cylinders.

51. The apparatus of claim 50, wherein the antenna cylinders are two metallic cylinders insulated by insulating material to form a dipole antenna.

52. The apparatus of claim 51, wherein the antenna cylinders include contact plates extending through apertures in the casing string.

53. The apparatus of claim 50, wherein the antenna cylinders include an interior circumferential electrical surface.

54. The apparatus of claim 50, wherein the antenna cylinders comprise casing joints insulated by insulation points.

55. The apparatus of claim 37, wherein the tool string antenna is an EM telemetry tool.

56. The apparatus of claim 37, wherein the tool string antenna is an antenna module, comprising:

an antenna coil disposed in an outer portion and a secondary coil disposed in an inner portion; and a sealed induction interface, wherein:

the sealed induction interface comprises an elastomer seal lip, and the elastomer seal lip is disposed around a metallic lip surrounding the secondary coil.

57. The apparatus of claim 56, wherein the antenna module further comprises a flange for mounting on a drill collar.

58. The apparatus of claim 57, wherein:

the tool string further comprises the drill collar, the antenna module is mounted on the drill collar with the flange, the flange having fastener holes disposed therethrough; and non-magnetic screws having self-locking threads, each screw disposed in a respective fastener hole.

59. A method for communicating between surface equipment and downhole equipment in a well, comprising:

providing the apparatus of claim 37;

transmitting data from the tool string antenna;

receiving the data at the casing string antenna; and sending data to the surface equipment via the control lines.

60. The apparatus of claim 37, wherein the downhole deployment valve (DDV) comprises:

a valve member movable between an open and a closed position, an axial bore therethrough in communication with an axial bore of the casing sting when the valve member is in the open position, the valve member substantially sealing a first potion of the casing bore from a second portion of the casing bore when the valve member is in the closed position, and a sensor configured to sense a parameter of the DDV or a parameter of the wellbore.

61. The apparatus of claim 60, wherein the sensor is a pressure sensor.

62. An apparatus for communicating between surface equipment and downhole equipment in a well, comprising:

a casing string cemented in the well, the casing string comprising an antenna;

one or more control lines in communication with the casing string antenna and the surface equipment, the control lines disposed along an outer surface of the casing string;

a tool string extending through the casing string, the tool string comprising an antenna; and the surface equipment located at a surface of the well.

63. An apparatus for communicating between surface equipment and downhole equipment in a well, comprising:

a casing string disposed in the well, the casing string comprising an antenna;

one or more control lines in communication with the casing string antenna and the surface equipment;

a tool string extending through the casing string, the tool string comprising an antenna;

a rotating drilling head in sealing engagement with the tool string; and the surface equipment located at a surface of the well.

64. An apparatus for communicating between surface equipment and downhole equipment in a well, comprising:

a casing string disposed in the well, the casing string comprising an antenna and a sensor;

one or more control lines in communication with the casing string antenna, the sensor, and the surface equipment;

a tool string extending through the casing string, the tool string comprising an antenna; and the surface equipment located at a surface of the well.

* * * * *

UNITED STATES PATENT AND TRADEMARK OFFICE

CERTIFICATE OF CORRECTION

PATENT NO. : 7,413,018 B2
APPLICATION NO. : 10/888554
DATED : August 19, 2008
INVENTOR(S) : Hosie et al.

It is certified that error appears in the above-identified patent and that said Letters Patent is hereby corrected as shown below:

In the Claims:

Column 16, Claim 32, Line 67, please delete "drilling" and insert --drill-- therefor;

Column 18, Claim 48, Line 11, please delete "case" and insert --casing-- therefor;

Column 18, Claim 54, Line 25, please delete "points" and insert --joints-- therefor.

Signed and Sealed this

Thirtieth Day of December, 2008

JON W. DUDAS
*Director of the United States Patent and Trademark Office*